US005738769A

United States Patent [19]

Chin

[11] Patent Number: 5,738,769

[45] Date of Patent: Apr. 14, 1998

[54] ANODE HOLDER

[76] Inventor: Raymond Yuen Keung Chin, 40 Tremain Street, Tingalpa, Queensland 4173, Australia

[21] Appl. No.: 621,102

[22] Filed: Mar. 22, 1996

[30] Foreign Application Priority Data

Aug. 11, 1995 [GB] United Kingdom ..... 9516479

[51] Int. Cl.[6] ..... C25B 11/03

[52] U.S. Cl. ..... 204/285; 204/297 R; 204/212

[58] Field of Search ..... 204/297 R, 212, 204/285

[56] References Cited

U.S. PATENT DOCUMENTS

| | | | |
|---|---|---|---|
| 3,417,007 | 12/1968 | Robinette et al. | 204/212 |
| 4,026,785 | 5/1977 | Ford | 204/297 R |
| 4,269,686 | 5/1981 | Newman et al. | 204/212 |
| 4,405,433 | 9/1983 | Payne | 204/297 R |

FOREIGN PATENT DOCUMENTS

| | | |
|---|---|---|
| 2011695 | 4/1994 | Russian Federation . |
| 749943 | 7/1980 | U.S.S.R. . |
| 1121325 | 10/1984 | U.S.S.R. . |
| 1730205 | 4/1992 | U.S.S.R. . |

*Primary Examiner*—Bruce F. Bell
*Attorney, Agent, or Firm*—Davis and Bujold

[57] ABSTRACT

A crank-pin anode holder (1) for the electro-plating industry follows the movement of a crank-pin to be plated which is rotating horizontally. During operation, non-metallic shoes (12) of a jaw plate (4) centralize themselves and sit on the crank-pin inside a plating solution. As the ends of the non-metallic shoes (12) are situated away from the jaw plates (4), it can prevent the holder (1) from contacting with the thrust produced and remove studs formed during the plating process. Anodes (2) with anode bags (11) are placed in both sides of the jaw plate (4) and each extend to an anode seat (5).

Two parallel channel chacks (3) can slide up and down with a preset button die therebetween mounted on a metal bar above the solution for electro-plating. A handle (7) is welded on the upper part of the right-hand channel chack (3) for use by the operator in carrying and setting. In the middle, there is a current copper bar (8), insulated from the channel chacks (3) by non-metallic bushes (9), and electrically connected with the two anodes (2). A cable (10) passes current from a bus bar to the copper bar (8) and thence to the anodes (2).

8 Claims, 2 Drawing Sheets

ANODE HOLDER

FIELD OF THE INVENTION

The present invention relates to an anode holder for use in crank-pin electro-plating operations.

BACKGROUND OF THE INVENTION

Previously proposed anode holders are fixed and immovable and the plated coating they produce is always uneven, porous, and with poor quality. Hydrogen is easily trapped in the covered area of the crank-pin which prevent coating formation on the crank-pin. There is also a problem with the formation of studs and the anodes are easily deformed after operating for a long time. As a result, customers often reject the job done and require costly remedial work.

The present invention provides an anode holder for use in electro plating of crank pins, the anode holder comprising two parallel channel chacks defining a channel therebetween, each channel chack having an upper end and a lower end and the channel having an open upper part between the upper ends of the channel chacks and anodes mounted within a jaw plate at the lower ends of the channel chacks.

A handle is preferably provided on one channel chack. A crankshaft, the crank-pins of which are to be plated and the anode holder are preferably set on a rotating hanger with the crankshaft rotating in a horizontal orientation under a plating solution. Preferably, a bus bar is attached to the hanger for passing current to the anodes. The anode holders follow the movement of the crank-pin and an even plated coating on the crankshaft can be produced.

Preferably, the anode holder sits on the crank-pin before operation. As the crankshaft rotates horizontally and non-metallic shoes fixed on the jaw plate maintain contact with the crank-pin and sweep away studs formed during plating process. A perfect, even, smooth and thick plated coating can then be made.

Preferably, each anode holder comprises the two parallel channel chacks, one handle, two jaw plates, numerous non-metallic shoes, two anode seats, a button die,two anodes covered with anode bags, a copper bar for connecting current, a cable and a cable clip.

Preferably, the parts of the anode holder not designed to carry electrical current are made of non-metallic material such as plastic or ceramic. If the anode holder is made of metal, it is preferably covered by insulated chemical coating to prevent direct interaction between plating solution and the current passing through the anode holder.

BRIEF DESCRIPTION OF THE DRAWINGS

The present invention is now described, by way of example only, with reference to the accompanying drawings, in which.

DESCRIPTION OF THE PREFERRED EMBODIMENT

Figure 1:
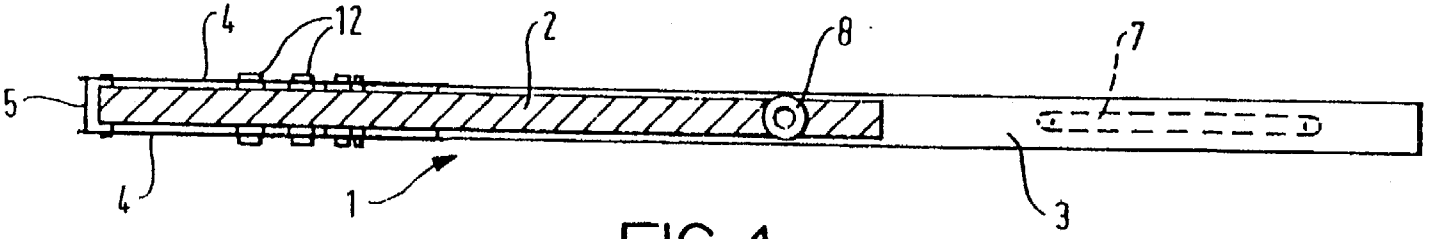
FIG. 1 is a side view of an entire anode holder according to the present invention but with a button die omitted.
Figure 2:
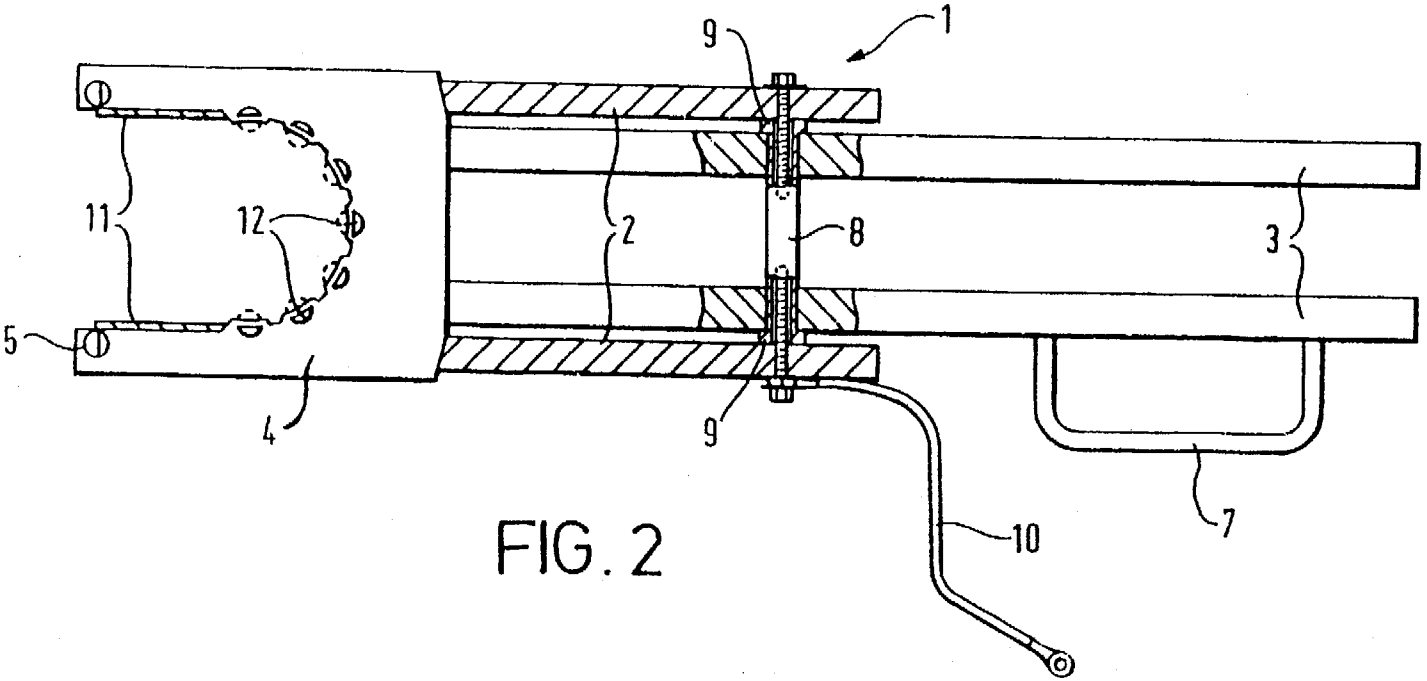
FIG. 2 is a front view of the whole anode holder of FIG. 1, again without button die, and shows how non-metallic shoes are installed on a jaw plate.

As shown in FIG. 1, an anode holder 1, has anodes 2 installed each parallel to a respect channel chack 3. The anodes 2 extend into a jaw plate 4 and each to a respective anode seat 5. The anodes 2 are locked up by the anode seats 5 and fixed.

The two channel chacks 3 are installed mouth to mouth, a button die 6 (FIG. 3) is placed between the channel chacks 3, and a handle 7 is welded on the right hand side at the back of the upper part of one channel chack.

Extending across the middle, a copper bar 8 for passing current is connected to the two anodes 2 but insulated from the two parallel channel chacks 3 by two non-metallic bushes 9. Current passes through a cable 10 from a bus bar (not shown) to the anodes 2.

The anodes 2 with anode bags 11 each extend from the middle of the respective channel chack 3 to the bottom of the jaw plate 4 and to non-metallic shoes 12 adjacent the anode seats 5. The anodes 2 are exposed from the jaw plate 4 with a wide angle for electro-plating. The end of each shoe 12 projects above the jaw plate 4. The anode bags 11 prevent contact between the anodes 2 and other parts of the holder. Especially in the case of ferrous plating the anode bags 11 are required to prevent polluting interaction between the anode's impurities and by-products and the electro-plating solution. The anode bags 11 can also act as a filter and beneficially affect the quantity of the end product.

At the saddle of the jaw, numerous ones of the non-metallic shoes 12 are installed along the upper half circle.

Figure 3:
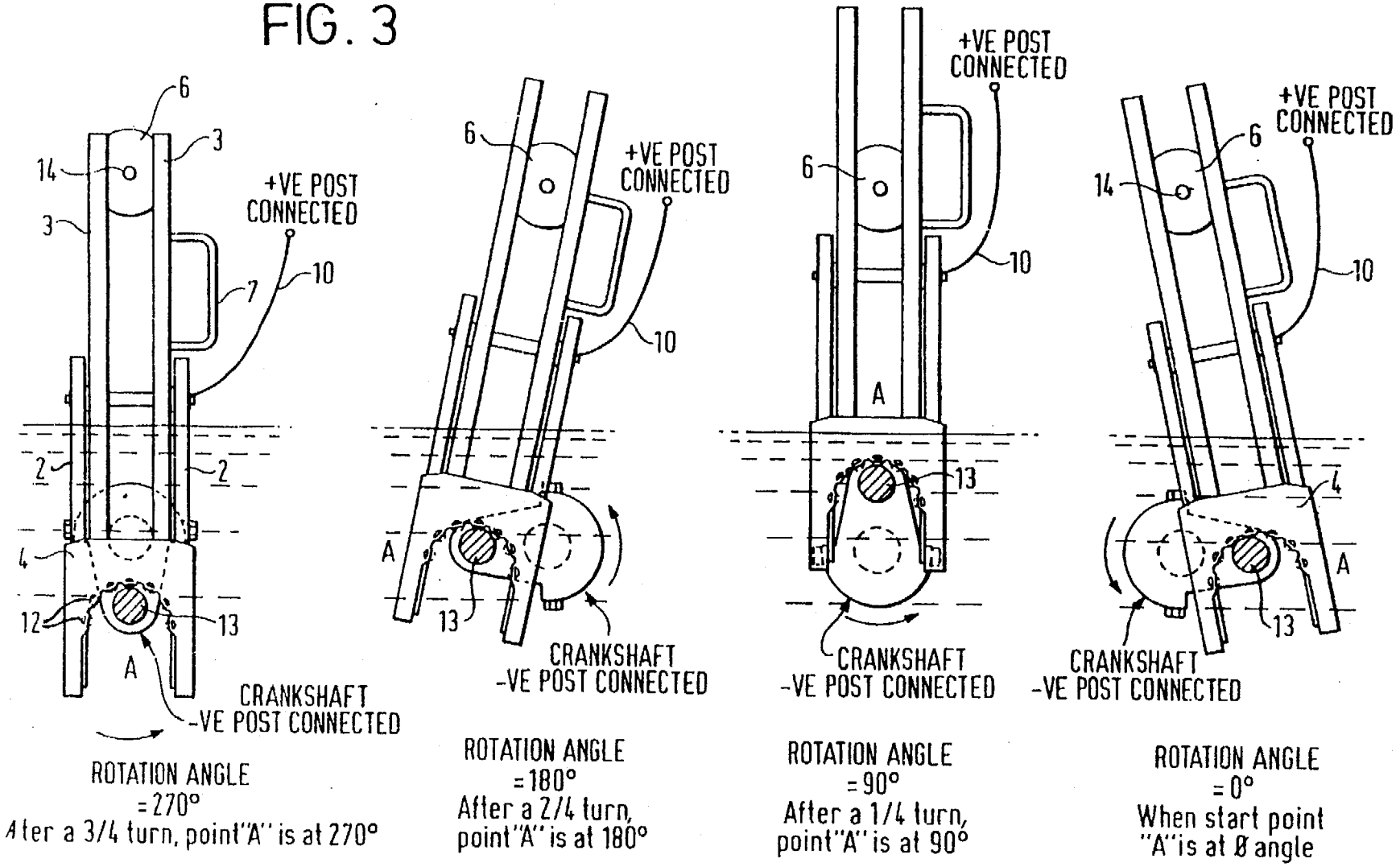
FIG. 3 is an anode holder according to the present invention in operation and particularly shows in the upper part two channel chacks with a button die and in the lower part a jaw plate with a crank-pin.

As can be seen in FIG. 3, the channel chacks 3 work in line with the button die 6, and the button die 6 is fixed by a screw on top of each crank-pin 13 to be plated and works as a shuttle inside the channel chacks 3. During operation, the anode holder 1 slides up and down, following the rotation movement of the crank pin 13. The non-metallic shoes 12 sit on the crank-pin 13 and centralise the anodes 2 which are installed at opposite sides of the holder 1.

A crankshaft which includes the crank-pins 13 is fixed on a rotating hanger. The button dies 6 of the anode holders 1 are placed along a metal bar 14 above the crank-pins 13 and fixed by screws on to the metal bar 14. When the crank-pins 13 are ready for electro-plating, the anodes 2 move towards the crank-pins 12. An operator can hold the handle 7 by hand and lift up the channel chacks 3, the channel chacks 3 then slide over the respective fixed button die 6. The jaw plate 4 is lifted and the saddle of the jaw fitted onto the crank-pin 13. The cables 10 are connected to the bus bar. A hoist is used to hang the crankshaft hanger into an electro-plating solution. A rotating device is turned on and the electro-plating process begins.

I claim:

1. An anode holder for use in electro-plating of crank-pins, the anode holder comprising:

two parallel channel chacks defining a channel therebetween, each channel chack having an upper end and a lower end and the channel having an open upper part between the upper ends of the channel chacks; and a jaw plate being supported by the lower ends of the channel chacks, and said jaw plate having anodes mounted therein.

2. An anode holder as claimed in claim 1 wherein there are two anodes with anode bags, the anodes are fixed by a copper bar at their upper ends to electrically connect them together, rest on anode seats at their lower ends and extend parallel to the channel chacks.

3. An anode holder as claimed in claim 2, having non-metallic shoes installed in a saddle of the jaw plate, the ends of non-metallic shoes being installed away from the jaw plates.

4. An anode holder as claimed in claim 2, having a cable connecting the anodes with a current bus bar.

5. An anode holder as claimed in claim 2, having a connecting copper bar isolated from the channel chacks by non-metallic bushes.

6. An anode holder as claimed in claim 2, wherein the anode seats are made of a non-metallic substance.

7. An anode holder as claimed in claim 1, to cooperate with a fixed button die and working as a shuttle, the fixed button die is placed between the channel chacks and the channel chacks moving up and down around the fixed button die.

8. An anode holder as claimed in claim 1 further comprising a handle provided on one of the channel chacks.

* * * * *